US007429251B2

(12) United States Patent
Tanizawa et al.

(10) Patent No.: US 7,429,251 B2
(45) Date of Patent: Sep. 30, 2008

(54) MASSAGING DEVICE HAVING CONTROLLER TO REMOVE DEAD POINTS DURING OPERATION

(75) Inventors: Takayoshi Tanizawa, Kanzaki-gun (JP); Masamichi Miyaguchi, Hikone (JP); Fumihiro Nishio, Hikone (JP); Daisuke Tsukada, Hikone (JP); Yuuichi Nishibori, Hikone (JP); Motoharu Muto, Osaka (JP)

(73) Assignee: Matsushita Electric Works, Ltd., Osaka (JP)

( * ) Notice: Subject to any disclaimer, the term of this patent is extended or adjusted under 35 U.S.C. 154(b) by 344 days.

(21) Appl. No.: 10/849,175

(22) Filed: May 20, 2004

(65) Prior Publication Data

US 2004/0243030 A1 Dec. 2, 2004

(30) Foreign Application Priority Data

May 27, 2003 (JP) ..... 2003-149806
May 27, 2003 (JP) ..... 2003-149813

(51) Int. Cl.
*A61H 15/00* (2006.01)

(52) U.S. Cl. ..... 601/94; 601/99; 601/100; 601/103; 601/116

(58) Field of Classification Search ..... 601/90, 601/94, 97, 98, 99, 100–103, 112, 113, 116; 297/217.1
See application file for complete search history.

(56) References Cited

U.S. PATENT DOCUMENTS 4,576,149 A 3/1986 Otuka et al.
4,586,493 A 5/1986 Goodman
5,083,552 A * 1/1992 Lipowitz ..... 601/84
5,165,205 A 11/1992 Nakagawa et al.
5,399,147 A * 3/1995 Kaiser ..... 601/34
5,792,080 A * 8/1998 Ookawa et al. ..... 601/115
6,056,707 A 5/2000 Hayashi et al.
6,117,094 A * 9/2000 Fujii ..... 601/99
6,749,577 B2 * 6/2004 Kume et al. ..... 601/99
2003/0149806 A1 8/2003 Achacoso et al.
2003/0149813 A1 8/2003 Bouchet

FOREIGN PATENT DOCUMENTS

EP 0 832 634 A1 4/1998
JP 60-24843 2/1985

(Continued)

OTHER PUBLICATIONS

European Search Report for application No. EP04012475 completed on Nov. 11, 2004.

(Continued)

*Primary Examiner*—Danton DeMille
(74) *Attorney, Agent, or Firm*—Cheng Law Group PLLC

(57) ABSTRACT

A massaging device gives different massaging patterns to different parts of a user's body for enhanced and pleasant massaging effect. The device includes an applicator applying a massage force to the user, and at least two driving units for driving the applicator to make different reciprocating movements respectively in different directions from each other. The least two driving units is controlled to reciprocate the applicator for providing the massaging force in different massaging patterns. A sensor is provided to acknowledge the position of the applicator. A massage pattern selector is provided to select one of the massaging patterns depending upon the position of the applicator.

10 Claims, 7 Drawing Sheets

FOREIGN PATENT DOCUMENTS

| | | | |
|---|---|---|---|
| JP | 60-145141 | | 7/1985 |
| JP | 63-97162 | | 4/1988 |
| JP | 63-097162 | A | 4/1988 |
| JP | 64-2852 | | 1/1989 |
| JP | 05-137761 | A1 | 6/1993 |
| JP | 05-161683 | | 6/1993 |
| JP | 05-200076 | | 8/1993 |
| JP | 06-125955 | | 5/1994 |
| JP | 07-039569 | | 2/1995 |
| JP | 07-136226 | A | 5/1995 |
| JP | 07-289600 | | 11/1995 |
| JP | 09-299423 | | 11/1997 |
| JP | 10-137137 | | 5/1998 |
| JP | 10-151164 | | 6/1998 |
| JP | 10-151164 | A | 6/1998 |
| JP | 10-201805 | | 8/1998 |
| JP | 2001-149435 | | 6/2001 |
| JP | 2001-269378 | | 10/2001 |
| JP | 2002-345914 | | 12/2002 |
| JP | 2003-265542 | | 9/2003 |
| JP | 2003-275264 | | 9/2003 |
| JP | 2004-254732 | | 9/2004 |
| WO | WO-96/25908 | | 8/1996 |

OTHER PUBLICATIONS

European Search Report dated Feb. 3, 2006.
Notification of Reasons for Refusal from Japan Patent Office, mailed Dec. 11, 2007.

* cited by examiner

FIG. 6
102
| Body Parts | Massage Pattern | Length | | Width | | Depth | |
|---|---|---|---|---|---|---|---|
| | | Lower limit | Upper limit | Lower limit | Upper Limit | Lower limit | Upper limit |
| Neck | Tx, Rx | 80 | 90 | 5 | 10 | 2 | 4 |
| Shoulders | Tx, Ty, Rx | 70 | 82 | 10 | 40 | 2 | 4 |
| Back | Ty, Rx | 20 | 70 | 10 | 20 | 1 | 2 |
| Waist | Tx, Rx | 0 | 20 | 10 | 35 | 1 | 2 |
FIG. 7A
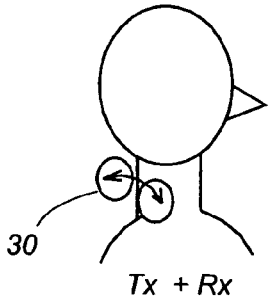
FIG. 7B
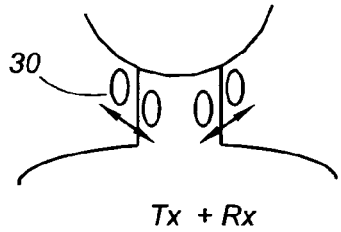
FIG. 8
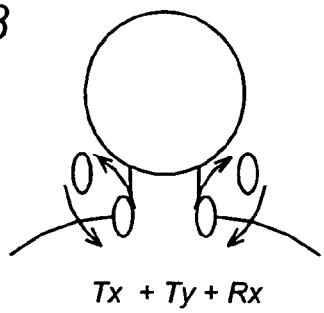
FIG. 9A
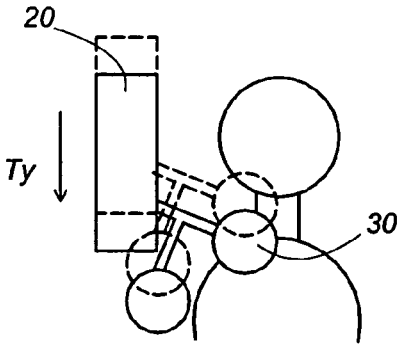
FIG. 9B
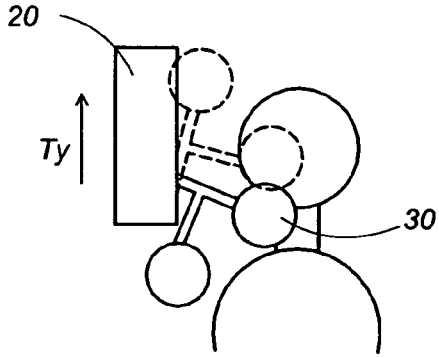

MASSAGING DEVICE HAVING CONTROLLER TO REMOVE DEAD POINTS DURING OPERATION

TECHNICAL FIELD

The present invention relates to a massaging device, and more particularly to the massaging device that provides a composite massage action composed of forces acting in different directions from each other for realizing a sophisticated massaging effect close to human touch.

BACKGROUND ART

Japanese Patent Publication No. 5-137761 discloses a typical prior art massaging device in the form of a chair. The device includes an applicator which moves along the user's back to apply the massaging force to various parts of a user's body including shoulders, back, and waist. For generating the massaging force, the applicator is driven to give a cyclic movement or reciprocation along a predetermined path. The applicator is interlocked with the driving unit to reciprocate along a rather complicated path for applying effective massaging force to the user's body. However, because of that the applicator is given only a single pattern of movement, i.e., a single massaging pattern, the device is found to be unsatisfactory for providing different massage patterns to different parts of the user's body.

DISCLOSURE OF THE INVENTION

In view of the above problem, the present invention has been accomplished to provide a unique massaging device which is capable of applying different massaging patterns to different parts of the body for enhanced and pleasant massaging effect. The massaging device in accordance with the present invention includes a base, and an applicator movably supported to the base. The device includes at least two driving units which drive the applicator to make different reciprocating movements respectively in different directions from each other. A controller is included in the device to control the at least two driving units to reciprocate the applicator for providing a massaging force to a user in different massaging patterns. Also included in the device is at least one sensor which senses a position of the applicator relative to the base for acknowledging the position at which the applicator applies the massaging force. The important feature of the present invention resides in that a massage pattern selector is provided to select one of the massaging patterns depending upon the position of the applicator. Thus, the user can enjoy the different massage patterns for different parts of the body.

Preferably, the controller may include a user profiler that receives a parameter identifying an user's body shape to determine specific locations of different body parts for allocating the different massaging patterns respectively to the specific locations, respectively. The massage pattern selector is cooperative with the user profiler to select one of the massaging patterns allocated to one of the specific locations of the user's body, in response to that the sensor gives the position of the applicator corresponding to one of the specific locations.

The driving units is preferred to include one that is configured to move the applicator towards and away from the user's body for realizing a pressing massage action.

Most preferably, the device includes three driving units, namely, a first driving unit, a second driving unit, and a third driving unit. The first driving unit is provided to reciprocate the applicator in a vertical direction along the height of the user's body. The second driving unit reciprocates the applicator in a lateral direction along the width of the user's body, and the third driving unit reciprocates the applicator in a depth direction along the thickness of the user's body.

Further, the massaging device in accordance with the present invention has an advantageous feature of making the combined reciprocating movements to achieve a composite massaging action, yet in a seamless fashion, thereby giving smooth and pleasant massaging touch close to an expertise. For this purpose, the controller is designed to include a coordinator which shifts a dead point of one of the reciprocating movements relative to a dead point of another of the reciprocating movements. Thus, when the applicator is intended to make the combination of the two reciprocating movements, the applicator can be kept moving in one reciprocation cycle while it remains around the dead point of the other reciprocation cycle.

Preferably, the coordinator is arranged to shift the phases of the reciprocating movements.

Further, the coordinator is arranged to monitor the phase of one of the reciprocating movements to detect a position of the applicator in the one movement. Based upon the detected position of the applicator, the coordinator shifts the phase of the other reciprocating movement relative to the phase of the one reciprocating movement by a time period in which the applicator moves to a predetermined position other than the dead point of its movement. Thus, the applicator can start moving away from the dead point in the one reciprocation cycle only after it reaches a position away from the dead point of the other reciprocation cycle. Accordingly, even if the applicator becomes temporality locked or stops due to a heavy load in one of the reciprocation cycle, the movement in the other reciprocation cycle can be shifted successfully and adequately only after the applicator advances actually to a predetermined position away from the dead point in the preceding reciprocation cycle, thereby avoiding concurrent rest of the applicator in both of the reciprocation cycles.

In addition, the device may include a timing adjustor which sets a variable time value which is added to the time period for varying the amount of the phase shift between the reciprocations. With the incorporation of the timing adjustor, the device can be well customized to give an optimum amount of the phase shift that the user can enjoy comfortable massaging effect. In this connection, the controller is preferably associated with a memory that stores the variable time set by the timing adjustor in order to hold the amount of the phase shift for enjoying the same massaging effect in a later use of the device.

The device may includes a pressure sensor which monitors a pressure being applied to the user's body by the applicator while the applicator makes one of said reciprocating movements. With the use of the pressure sensor, the coordinator can acknowledge the predetermined position of the applicator when the pressure sensor provides a particular output, which makes it easy to detect the actual position of the applicator in relation to the user's body.

These and still advantageous features of the present invention will become more apparent from the following detailed description of the embodiment, when taking in conjunction with the attached drawings.

BRIEF DESCRIPTION OF THE DRAWINGS

FIG. 6 shows contents of a massage pattern table that is referred to in controlling the operation of the device;

FIGS. 7 to 11 are schematic views illustrating various massaging patterns realized by the above device.

BEST MODE FOR CARRYING OUT THE INVENTION

Figure 1:
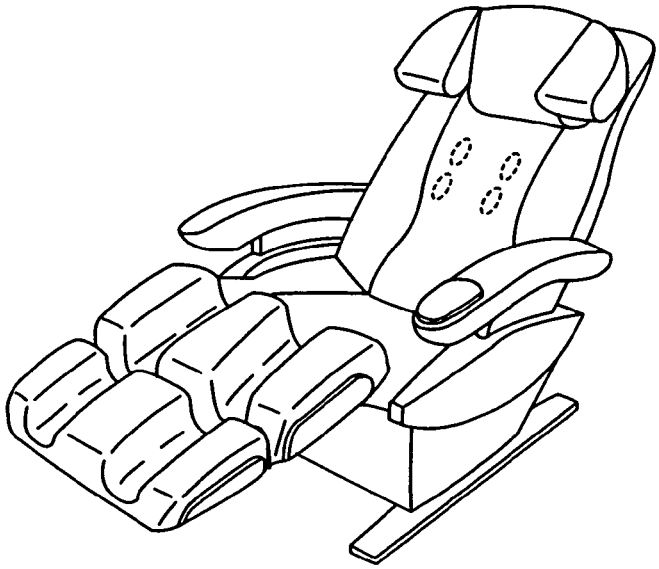
FIG. 1 is a perspective view of a massaging device in accordance with a preferred embodiment of the invention.

Referring to FIGS. 1 to 5, there is shown a massaging device in accordance with a preferred embodiment of the present invention. The massaging device is realized in the form of a chair having a framework or base 10 carrying an applicator module 20 embedded in a backrest 12 of the chair. The applicator module 20 is supported to the base 10 to be vertically movable along the length of the backrest 12. The applicator module 20 includes a pair of applicators 30 each composed of a set of vertically spaced rings which are supported to a cradle 32 so that, as will be discussed later in detail, the applicators 30 are movable relative to the module 20 along a lateral axis as well as about the axis X. As the module 20 itself is movable in the vertical direction relative to the base, the applicators are given three (3) degrees of freedom relative to the base 10, i.e., a lateral translational movement Tx along the lateral axis (X), a vertical translational movement Ty along the length (Y) of the base 10, and a rotational or swivel movement Rx about the lateral axis (X). The swivel movement Rx of the applicator inherently includes a depth translation Tz in a direction perpendicular to the axes (X) and (Y), and the vertical translational movement Ty. One and suitable combinations of these movements are selected to give a massaging force in various patterns to different parts of the user's body. Only for sake of simplicity, the term "applicator" is used in the claims and other portions of the description to collectively refer to the applicators 30 in the sense that it applies the massaging force to the user.

Figure 2:
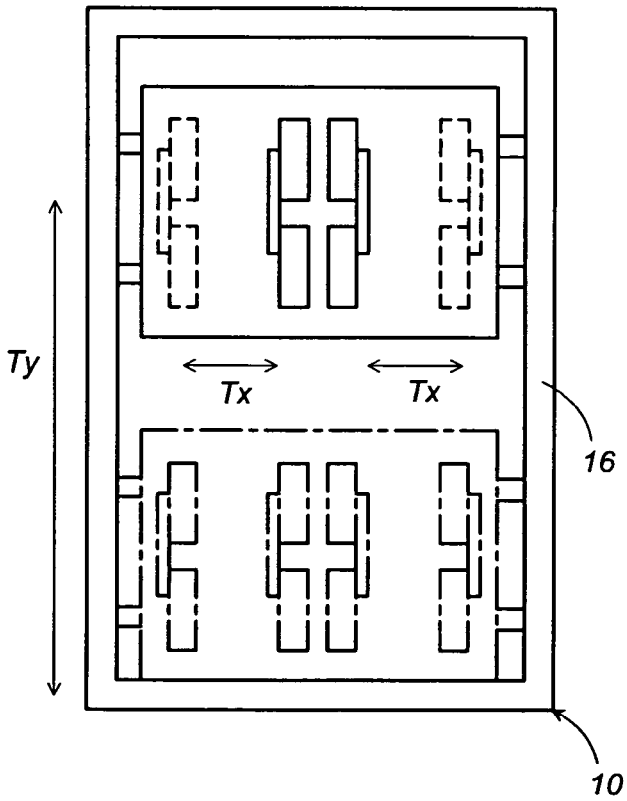
FIGS. 2 and 3 are schematic views of an applicator module employed in the above device.
Figure 3:
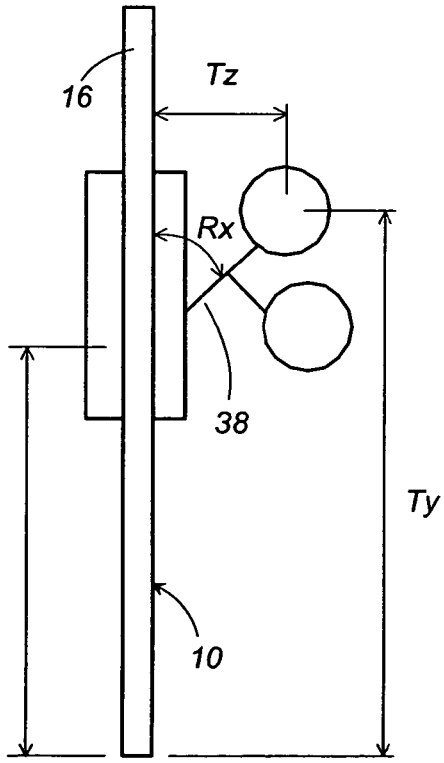

The applicator 30 is driven by three independent driving units or motors 41, 42, and 43 to reciprocate in the different directions, i.e., to make the reciprocations of Tx, Ty, and Rx. FIG. 2 shows the lateral and vertical translational movements Tx and Ty of the applicator 30 relative to the base 10, developing the corresponding massaging forces being applied to the user's body in the directions (X) and (Y), respectively. FIG. 3 shows the swivel movement Rx of the applicator 30 relative to the module 20 and therefore the base 10, with associated depth and vertical translational movements Tz and Ty for applying a corresponding massaging force to the user's body with varying pressing strength.

The three individual reciprocatory movements are suitably combined to develop the massage force in various massage patterns, for simulating human touch massage actions including rubbing, kneading, and combinations thereof. The device is programmed to allocate the massage patterns to different parts of the body. For this purpose, the device is provided with various sensors for determining the current position of the applicator 30 as well as an input 101 that receives a user's body parameter for determination of the locations of various parts of the body, i.e., neck, shoulder, and waist.

Figure 4:
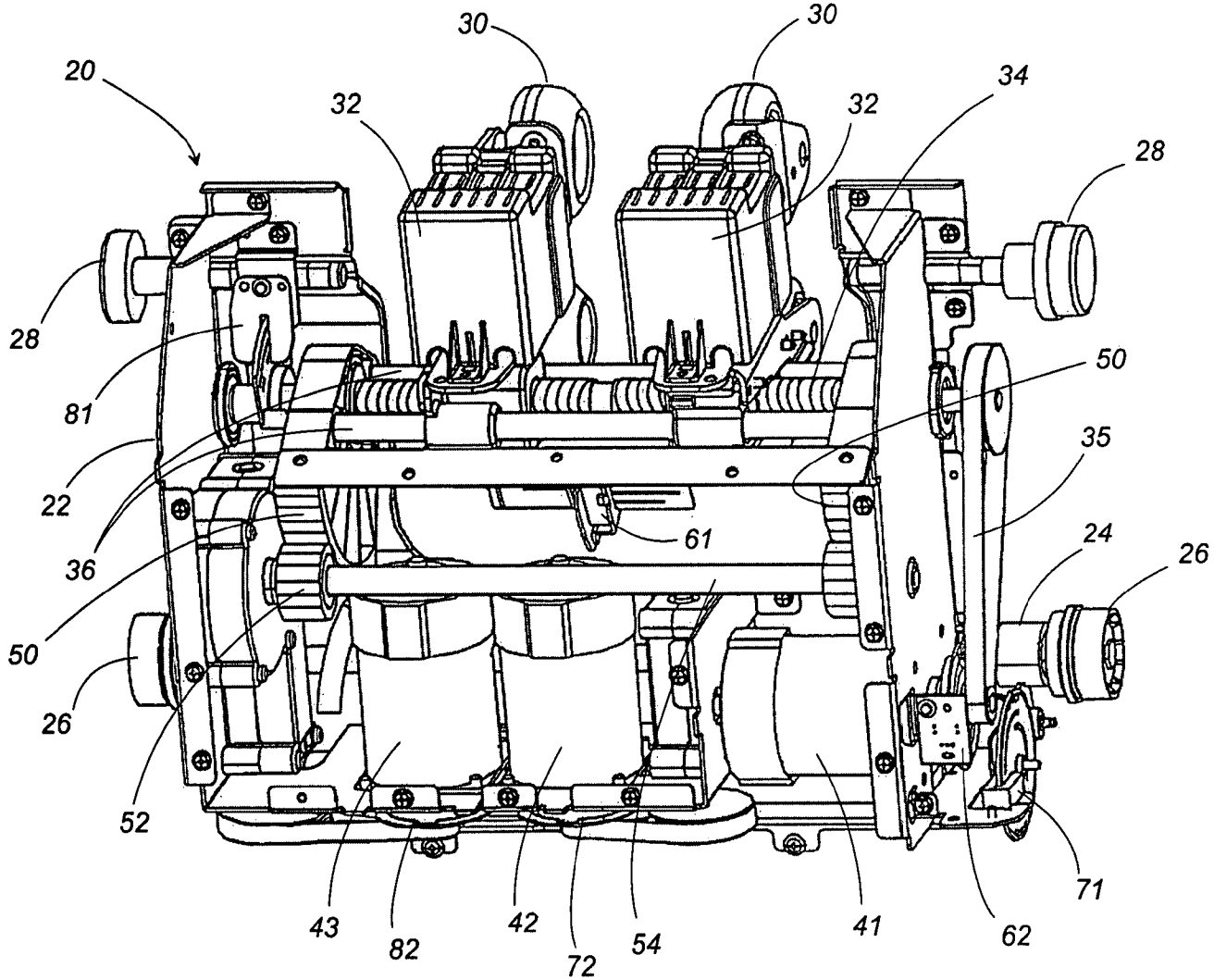
FIG. 4 is a perspective view of the applicator module.

Prior to discussing a controlled operation of the applicator, a mechanism of driving the applicator 30 is explained with reference to FIG. 4. The applicator module 20 has a chassis 22 carrying the three electric motors 41, 42, and 43, in addition to the cradles 32 each mounting the applicators 30 by means of a bifurcated arm 38, as shown in FIG. 3. The chassis 22 includes a horizontally extending drive shaft 24 formed at its opposite ends with gears 26 which mesh respectively with vertical racks 16 of the base 10. The drive shaft 24 is driven by the motor 42 to reciprocate the module 20 vertically along the length of the base 10, thereby giving the vertical movement Ty to the applicator 30. Guide rollers 28 are mounted to the chassis 22 in vertically spaced relation to the gears 26, and are kept in rolling contact with the racks 16 for vertically guiding the module 20.

The cradles 32 are engaged with a common screw shaft 34 in a laterally spaded relation with each other so as to effect the lateral translational movement Tx in such a manner that the cradles 32 moves toward and away from each other as the screw shaft 34 rotates in the opposite directions, respectively. The screw shaft 34 is connected to the motor 41 by means of a belt 35 so as to be driven to rotate thereby.

The cradle 32 is supported to a pair of horizontal axles 36 which extend between horizontally spaced swing gears 50 in parallel with the screw shaft 34. Each swing gear 50 is a fan-shaped gear pivotally supported at its center to the screw shaft 34 and is fixed to the axles 36. The swing gears 50 mesh respectively with pinions 52 formed at opposite ends of a horizontal shaft 54 driven by the motor 43 so that the swing gears 50 causes the cradles 32 and therefore the applicator 30 to swivel about the axis of the screw shaft 34 as the motor 42 rotates in the opposite directions.

Thus, the applicator 30 can be driven by the individual motors 41, 42, and 43 to effect the reciprocal translational movements Tx, Ty as well as swivel movement Rx in any combination by a controller 100 included in the device, thereby producing composite massage forces of the different massage patterns.

Further, the module 20 includes a width sensor composed of a position sensor 61 and a speed sensor 62 respectively for detection of the current position and speed of the applicator 30. The position sensor 61 is disposed adjacent the center of the screw shaft 34 for monitoring the lateral translational movement Tx of the cradle 32, i.e., the applicator 30, while the speed sensor 62 is disposed adjacent the motor 41 for monitoring the displacement speed of the applicator in terms of the rotation speed of the motor. Also included in the module 20 is a height sensor composed of a position sensor 71 disposed adjacent one of the gears 26 for monitoring the vertical translational movement Ty of the module 20 in relative to the base 10, and a speed sensor 72 disposed adjacent the motor 42 for monitoring the traveling speed of the module 20, i.e., the applicator in terms of the rotation speed of the motor. Further, the module 20 is provided with a strength sensor composed of a position sensor 81 disposed adjacent the one of the swing gears 50 for monitoring the swivel movement Rx of the cradle 32 about the screw shaft 34, and a speed sensor 82 disposed adjacent the motor 43 for monitoring the swinging speed of the applicator in terms of the rotation speed of the motor.

Figure 5:
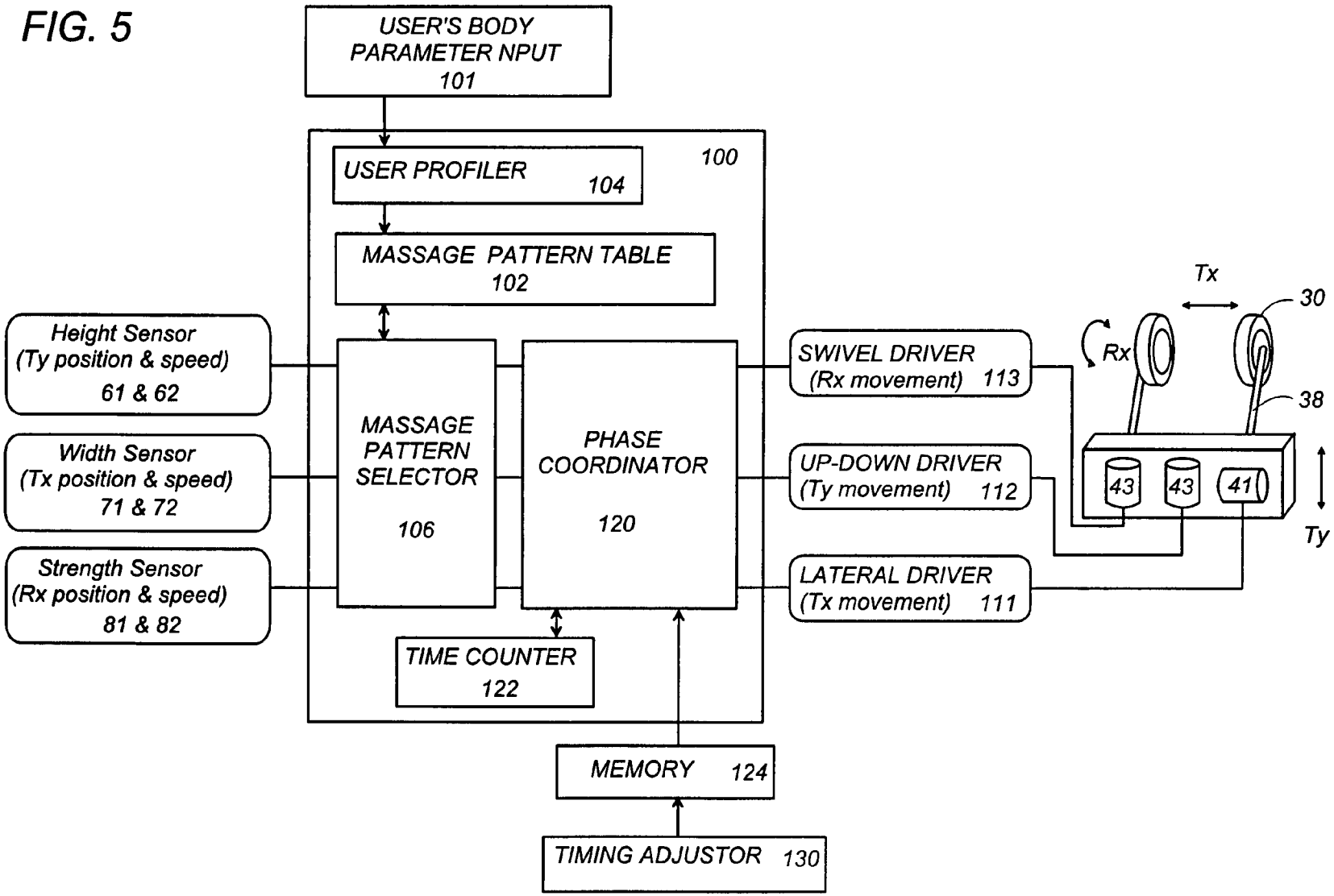
FIG. 5 is a block diagram illustrating a circuit arrangement of the above device.

Now, the operation of the device is explained with reference to FIG. 5. The controller 100 is provided to control the motors 41, 42, and 43 for realizing the different massage patterns as mentioned in the above. Basically, the controller 100 is programmed to move the applicator 30 or the applicator module 20 vertically in a predetermined schedule to cover the length of the user, for example, between the neck to the waist, while controlling the applicator 30 to stay at the different body parts, i.e., neck, shoulders, back, and waist for a predetermined time period in order to effect the local massages.

Included in the controller 100 is a massage pattern table 102 which is preset to allocate the different massage patterns to different body parts, and which correlates the individual body parts respectively with ranges that are different from users of different body shapes. As exemplarily shown in FIG. 6, the pattern table 102 is configured to have records each related to one of the body parts, with each record giving the particular massage pattern and the ranges describing the body part with numerical values for lower and upper limits with regard to the length, width, and depth dimensions.

The numerical values are variables that vary with the users of different body shapes. In order to customize the device for each of different users, the device includes a user profiler 104 which receives from a user's body parameter input 101 a parameter identifying a user's body shape and estimates the locations of the respective body parts. That is, the profiler 104 determines and gives the numerical values to the pattern table 102 that designate the ranges of the body parts specific to the particular user. The user's body parameter input 101 is realized by a key pad where the user can enter the characteristic value such as height or the like identifying the shape of the user's body. Initially, the pattern table 102 is set to have the numerical values which designate a standard body shape.

The controller 100 includes a massage pattern selector 106 which acknowledges the current position of the applicator 30 from the outputs of the sensor 61 to determine which one of the body parts meets the applicator 30 with reference to the pattern table 102, and selects the massage pattern allocated to thus determined body parts. Then, the massage pattern selector 106 activates or deactivates a driving circuit provided for driving the motors 41, 42, and 43, thereby reciprocating the applicator 30 in match with the selected massage pattern. The driving circuit includes a lateral driver 111 which drives the motor 41 to effect the laterally reciprocating translational movement Tx of the applicator 30, an up-down driver 112 which drives the motor 42 to effect the vertically reciprocating translational movement Ty of the applicator 30, and a swivel driver 113 which drives the motor 43 to effect the reciprocatory swiveling movement Rx of the applicator 30. In making the respective reciprocating Tx, Ty, and Rx, the massage pattern selector 106 refers to the pattern table 102 to find the allowed ranges of the movements, while monitoring the current position of the applicator 30 by the sensors 61, 71, and 81, in order to issue individual signals to the respective drivers 111, 112, and 113 for reciprocating the applicator 30 within the allowed ranges.

<Neck Massage>

When the pattern selector 106 decides to massage the neck, it is firstly made to control the drivers 111 to 113 to place the applicator 30 at position in touch with the neck, while referring to the numerical values in the table 102 indicating the physical information about the particular user, as well as to the current positions of the applicator 30 gathered from the outputs of the sensors 61 to 63. Then, the pattern selector 106 controls the lateral driver 111 and the swivel driver 113 to make the selected massage pattern, i.e., effecting the laterally reciprocating movement Tx concurrently with the reciprocatory swivel movement Rx for kneading the neck, as shown in FIGS. 7A and 7B.

<Shoulder Massage>

When the pattern selector 106 decides to massage the shoulders, it moves the applicator 30 to a right position in touch with the shoulders of the user in the like manner as discussed in the above, and subsequently controls all the drivers 111, 112, and 113 to make the selected massage pattern, i.e., effecting the vertically reciprocating translational movements Tx and Ty concurrently with the swiveling movement Rx for kneading the shoulder with varying pressing strength, as shown in FIG. 8.

Alternatively, when the pattern table 102 is set to make only the vertically reciprocating translational movement Ty, the pattern selector 106 controls the up-down driver 112 to make such massage pattern for pressing the shoulders with varying strength, as shown in FIGS. 9A and 9B.

<Back Massage>

Figure 10:
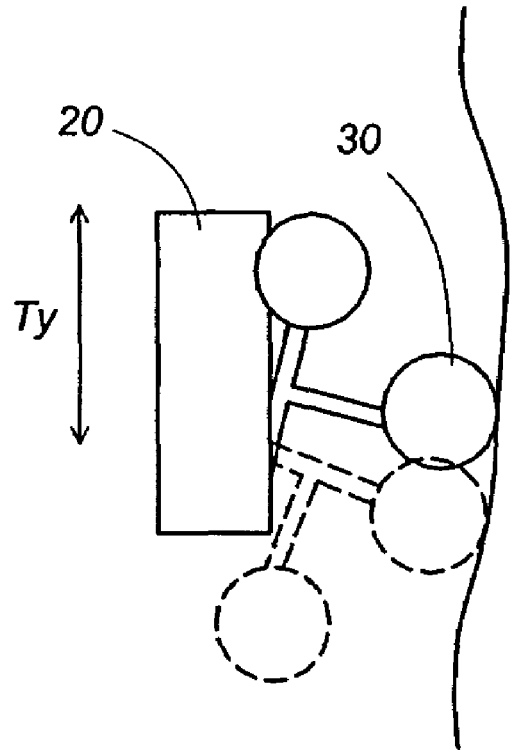

When the pattern selector 106 decides to massage the back, it moves the applicator 30 to a right position in touch with the back of the user. The vertical position of the applicator 30 is set to one of the lower and upper limits read from the pattern table 102. Then, the selector 106 controls only the up-down driver 112 to make the selected massage pattern, i.e., effecting the vertically reciprocating translational movement Ty, for rubbing the back of the user, as shown in FIG. 10.

<Waist Massage>

Figure 11:
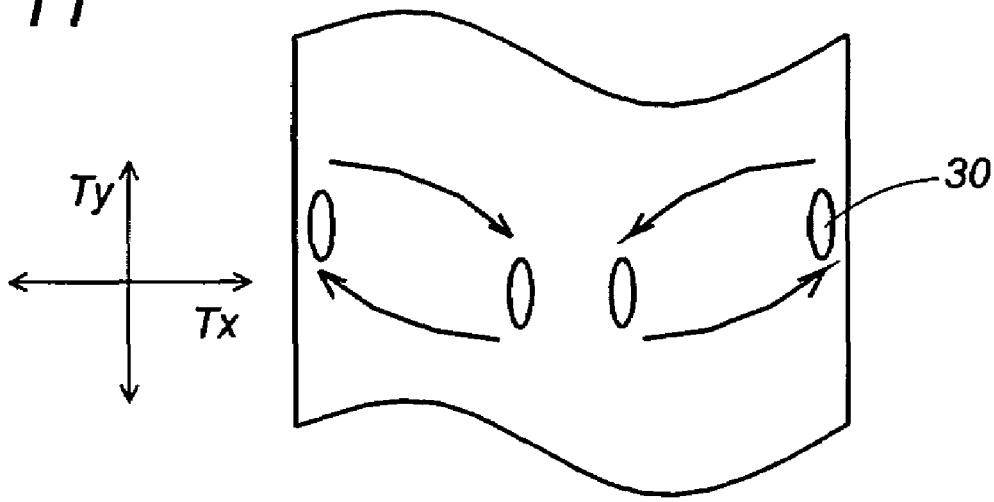

When the pattern selector 106 decides to massage the waist, it moves the applicator to a right position in touch with the waist, and subsequently controls the lateral driver 111 and the up-down driver 112 to effect the intended reciprocatory translational movements Tx and Ty concurrently for rubbing the waist, as shown in FIG. 11.

It should be noted in this connection that the massage patterns may be selected from one or any combination of the reciprocatory movements Tx, Ty, and Rx, and may be allocated to the different body parts in a relation other than that disclosed herein.

Figure 12:
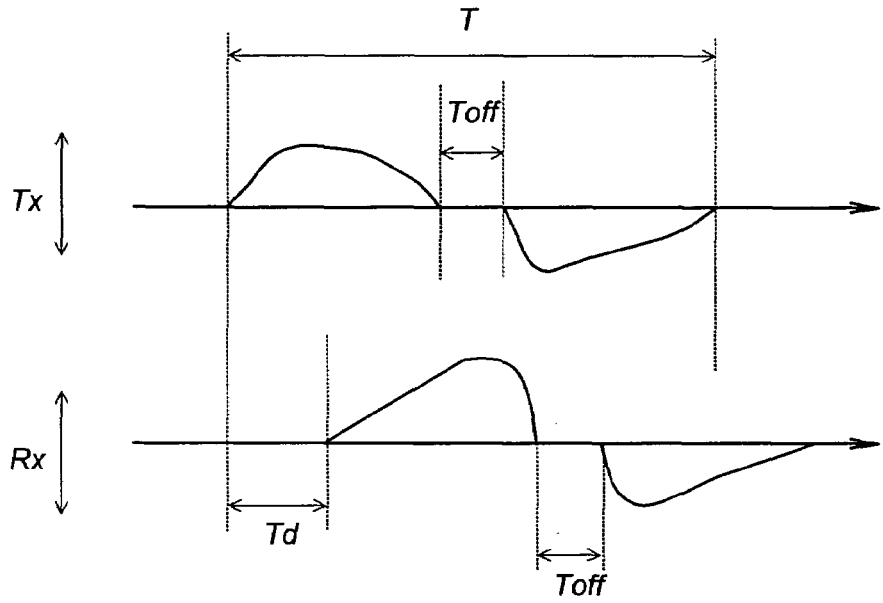
FIGS. 12 to 14 are graphs illustrating various operations intended by the above device.

Also included in the controller 100 is a phase coordinator 120 which is designed to avoid concurrent interruption of the two reciprocatory movements selected by the massage pattern selector 106, in order to keep moving the applicator 30 in at least one of the reciprocatory movements while the applicator 30 rests temporarily, i.e., remains around the dead point in another of the reciprocatory movements. In other words, when the massage pattern designates two reciprocatory movements, for example, the vertical and lateral transitions Tx and Ty, the coordinator 120 gives a phase shift between the two reciprocatory movements so as to shift the dead points of the movement Tx relative to those of the movement Ty. In this connection, it is noted that the applicator 30 is given the reciprocatory movements Tx, Ty, and Rx each having a predetermined rest period Toff at the dead points of each movement within one complete cycle T, as shown in FIGS. 12 to 14.

The coordinator 120 receives from the pattern selector 106 the information of the massage patterns currently selected so as to determine which one of the movements Tx, Ty, and Rx is given the phase shift from the one or ones of the remaining movements, with reference to a predetermined relation. FIG. 12 shows the phase shift determined at the coordinator 120 between the two movements, i.e., the lateral translational movement Tx and the swivel movement Rx. In this case, the swivel movement Rx of the applicator 30 is caused to start the cycle with a delay (Td) from the start of cycling the translational movement Tx. In FIG. 3 which shows the phase shift between the three movements Tx, Rx, and Ty, the movement Ty starts cycling with the delay (Td) from the start of cycling the translation Tx and swiveling movement Rx. The delay (Td) is given as a predetermined time counted at a time counter 122.

Figure 13:
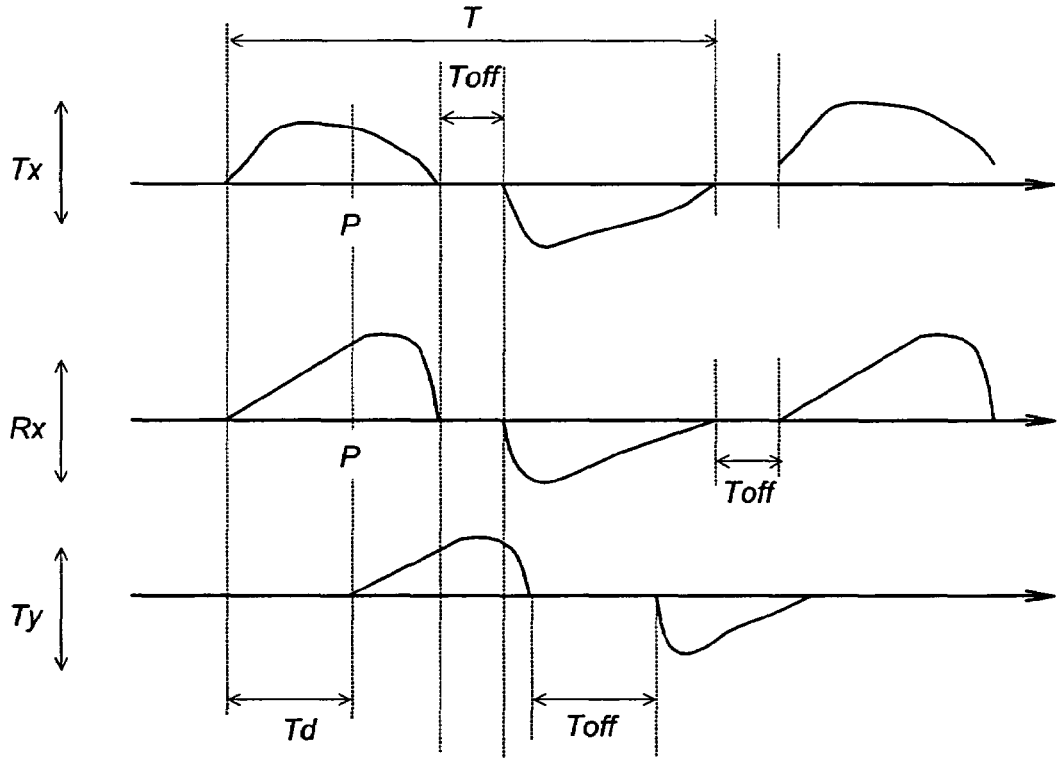
Figure 14:
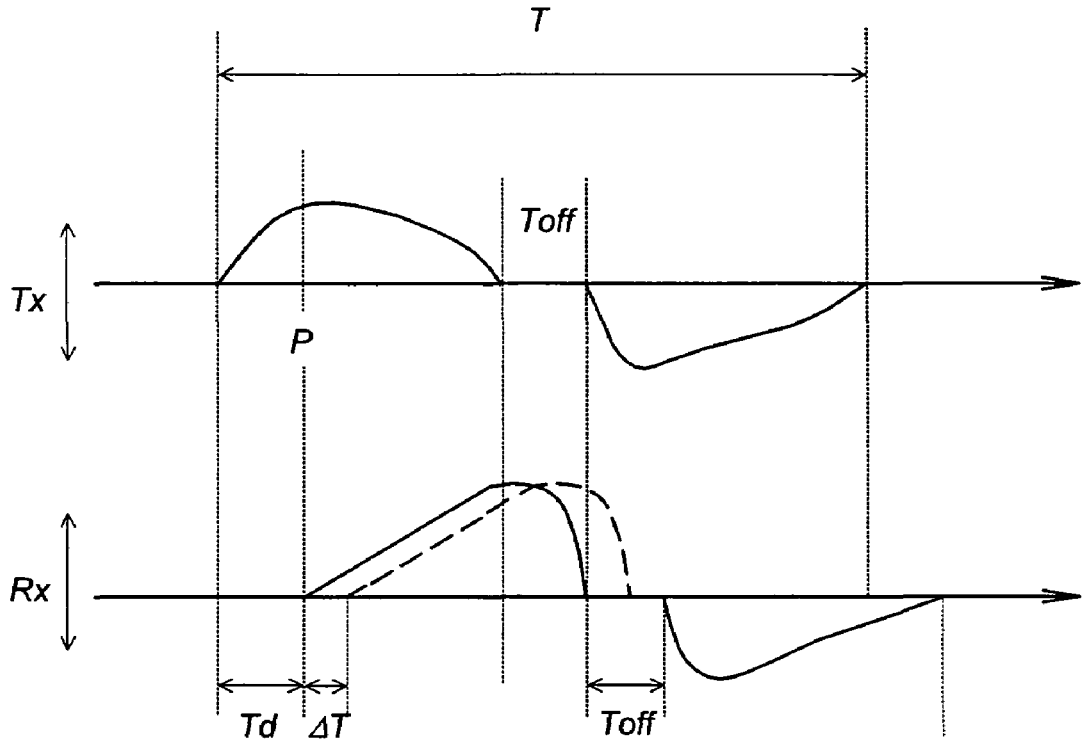

In addition, the coordinator 120 monitors the current position of the applicator 30 its respective movements Tx, Ty, and Rx by use of the sensors 61, 71, and 81 to determine the delay (Td) as a phase difference between the two movements, for example, Tx or Rx and Ty in FIG. 13. When the coordinator 120 acknowledges that the applicator 30 actually advances to a predetermined position or phase angle P away from the dead point in its movement Tx or Rx, the coordinator 120 starts cycling the applicator 30 in the other movement Ty, thereby making the phase shift between the two movements of the applicator 30 in exact reflectance of the actual position of the applicator in the preceding movement Tx or Rx. With this result, it is made to avoid the concurrent resting of the applicator 30 which would occur if the preceding movement is locked or remains in the dead point temporarily under a heavy load. The above scheme of making the delay based upon the current applicator position is added with the scheme of making the delay by counting the time such that the coordinator 120 makes the phase shift when both of the schemes determines the delay (Td). However, anyone of the above scheme alone may be selected as necessary.

Alternatively, the coordinator 120 may be configured to detect a pressure being applied by the applied to the user's body in each of the movements Tx, Ty, and Rx from the combination of the position data and the speed data gathered respectively from the sensors 61 & 62, 71 & 72; 81 & 82, and judges the actual position or phase angle of the applicator 30 in each of the movements Tx, Ty, and Rx based upon thus detected pressure for determination of the delay (Td). In this connection, the device may be equipped with pressure sensors, in addition to the sensors described with reference to FIG. 4.

Further, the coordinator 120 is configured to vary the amount of the delay (Td) by a correction ΔT, as shown in FIG. 14. The correction ΔT is variably set at a timing adjustor 130 and is stored in a memory 124 such that the corrected amount of delay (Td+ΔT) is kept until it is reset or set to another value. The timing adjustor 130 is provided in the form of a key pad or the like input device to be accessible by the user. With the added function of varying the amount of delay (Td), the device can be easily adapted for providing comfortable massage action that the user prefers.

Although the illustrated embodiment shows only the two models in which the movement Rx or Ty is delayed relative to the other movement merely for simplifying the explanation, the device is arranged to delay anyone of the movements relative to one or more of the other movements.

Also in the illustrated embodiment, the coordinator 120 is explained in connection with the massage pattern selector 106. However, the coordinator 120 can operate independently from the massaging pattern selector 106 and gives the distinctive advantage as discussed in the above, and therefore can have an independent status of protection.

Further, the present invention should not be limited to the use of the three movements Tx, Ty, and Rx given to the applicator, and should be interpreted to use any other movements of the applicator in different directions with one another.

This application is based upon and claims the priority of Japanese Patent Application No. 2003-149806, filed in Japan on May 27, 2003 and Japanese Patent Application No. 2003-149813, filed in Japan on May 27, 2003, the entire contents of which are expressly incorporated by reference herein.

The invention claimed is:

1. A massaging device comprising:

a base;

an applicator which is movably supported to said base, said applicator being configured to come into contact with a part of a human body such as a back;

at least two driving units which drive said applicator, said at least two driving units being configured to cause said applicator to make different reciprocating movements, respectively in different directions from each other relative to said human body, thereby applying a composite massaging force thereto;

a controller configured to control said at least two driving units for reciprocating said applicator in different directions, thereby providing said massaging force to the user selectively in one of different massaging patterns which are defined by combinations of said reciprocating directions;

sensor means configured to detect current positions of said applicator respectively with regard to said different directions; and a coordinator included in said controller and being configured to shift by a time period a phase of a first reciprocating movement of said applicator relative to a phase of a second reciprocating movement of said applicator, wherein said shift of said time period is of a duration within said phase of said second reciprocating movement.

2. The massaging device as set forth in claim 1, wherein said controller includes a user profiler that receives a parameter identifying an user's body shape to determine specific locations of different body parts for allocating said different massaging patterns respectively to said specific locations, respectively, and a massage pattern selector selecting one of said massaging patterns allocated to one of said specific locations of the user's body, in response to that said at least one sensor gives the position of said applicator that corresponds to said one of the specific locations.

3. The massaging device as set forth in claim 1, wherein one of said at least two driving units is configured to move said applicator towards and away from the user's body for realizing a pressing massage action.

4. The massaging device as set forth in claim 1, wherein said at least two driving units is composed of a first driving unit, a second driving unit, and a third driving unit, said first driving unit reciprocating said applicator in a vertical direction along the height of the user's body;

said second driving unit reciprocating said applicator in a lateral direction along the width of the user's body, and said third driving unit reciprocating said applicator in a depth direction along the thickness of the user's body.

5. The massaging device as set forth in claim 1, wherein said coordinator is configured to detect a position of the applicator in said reciprocating movement in said one direction, said coordinator being configured to shift the phase of said reciprocating movement in said one direction relative to the phase of said reciprocating movement in said another direction by a time period in which said applicator moves to a predetermined position other than the dead point of said reciprocating movement in said another direction.

6. The massaging device as set forth in claim 5, wherein said device includes a timing adjustor which sets a variable time value which is added to said time period for varying the amount of the phase shift between said reciprocating movements.

7. The massaging device as set forth in claim 5, wherein said sensor means includes position sensors configured to detect positions of the applicator respectively with regard to said different directions, and speed sensors configured to detect the speed of said applicator reciprocating respectively with regard to said different directions, said coordinator being configured to detect a pressure being applied by the applicator in each of said different directions from the combination of the detected position and speed, and to determine said phase angle based upon the detected pressure for determination of said phase shift.

8. The massaging device as set forth in claim 6, wherein said device includes a memory that stores said variable time set by said timing adjustor in order to hold said amount of the phase shift.

9. A massaging device comprising:

a base;

an applicator which is movably supported to said base, said applicator being configured to come into contact with a part of a human body such as a back;

at least two driving units which drive said applicator, said at least two driving units being configured to cause said applicator to make different reciprocating movements, respectively in different directions from each other relative to said human body, thereby applying a composite massaging force thereto, said different reciprocating movements each having a reciprocation cycle and at least one dead point and at least one movement within said reciprocation cycle;

a controller configured to control said at least two driving units for reciprocating said applicator in different directions, thereby providing said massaging force to the user selectively in one of different massaging patterns which are defined by combinations of said reciprocating directions;

sensor means configured to detect current positions of said applicator respectively with regard to said different directions; and a coordinator included in said controller and being configured to shift by a time period a phase of said reciprocation cycle of one of said reciprocating movements relative to a phase of said reciprocation cycle of another of said reciprocating movements wherein simultaneous occurrence of dead points during said reciprocation cycles of all of said different reciprocating movements is avoided.

10. The massaging device as set forth in claim 9, wherein said shift of said time period is of a duration within the phase of said reciprocation cycle of another of said reciprocating movements.

* * * * *